US008950023B2

(12) United States Patent
Jacobsen et al.

(10) Patent No.: US 8,950,023 B2
(45) Date of Patent: Feb. 10, 2015

(54) MULTIPURPOSE ATTACHABLE PROTECTIVE BLANKET

(71) Applicants: Seth Jacobsen, Wilmington, NC (US); Julia Jacobsen, Wilmington, NC (US)

(72) Inventors: Seth Jacobsen, Wilmington, NC (US); Julia Jacobsen, Wilmington, NC (US)

( * ) Notice: Subject to any disclaimer, the term of this patent is extended or adjusted under 35 U.S.C. 154(b) by 0 days.

(21) Appl. No.: 13/872,192

(22) Filed: Apr. 29, 2013

(65) Prior Publication Data

US 2014/0317844 A1 Oct. 30, 2014

(51) Int. Cl.
*A47C 31/10* (2006.01)
*A47G 9/02* (2006.01)

(52) U.S. Cl.
CPC ..... *A47G 9/0223* (2013.01)
USPC ..... 5/482; 5/417; 5/488; 5/495; 5/496; 5/498

(58) Field of Classification Search
USPC ..... 5/417, 418, 419, 420, 656, 482, 488, 5/495, 496, 498
See application file for complete search history.

(56) References Cited

U.S. PATENT DOCUMENTS

| | | | | | |
|---|---|---|---|---|---|
| 4,658,454 | A * | 4/1987 | Potter | 5/497 |
| 4,914,767 | A * | 4/1990 | Balicki et al. | 5/419 |
| 4,916,766 | A * | 4/1990 | Grandy | 5/496 |
| 5,249,320 | A * | 10/1993 | Moretz et al. | 5/484 |
| 5,353,456 | A * | 10/1994 | Evans | 5/493 |
| 5,375,280 | A * | 12/1994 | O'Sullivan et al. | 5/662 |
| 5,432,965 | A * | 7/1995 | Espinoza | 5/482 |
| 5,794,285 | A * | 8/1998 | Burch | 5/497 |
| 5,933,885 | A * | 8/1999 | Glassford | 5/424 |
| 6,192,536 | B1 * | 2/2001 | Connors | 5/417 |
| 7,984,522 | B1 * | 7/2011 | Pfleger | 5/493 |
| 8,015,637 | B2 * | 9/2011 | Papen et al. | 5/502 |
| 8,332,976 | B1 * | 12/2012 | Goldwater | 5/484 |
| 8,689,375 | B2 * | 4/2014 | Stinchcomb | 5/502 |
| 2007/0271699 | A1 * | 11/2007 | Sacchetti | 5/495 |
| 2008/0289105 | A1 * | 11/2008 | Ranzau | 5/482 |
| 2009/0070933 | A1 * | 3/2009 | Hall | 5/496 |
| 2012/0284917 | A1 * | 11/2012 | Nirmel | 5/417 |
| 2014/0033430 | A1 * | 2/2014 | Daugherty et al. | 5/494 |

* cited by examiner

*Primary Examiner* — Robert G Santos
*Assistant Examiner* — David E Sosnowski

(57) ABSTRACT

A multipurpose blanket system includes blanket material and a first pair of fasteners configured to fasten to one another. The blanket may be constructed using sun protective, breathable material. A first fastener of the first pair is positioned along a first direction relative to a second fastener of the first pair. A second pair of fasteners may be configured to fasten to one another. A third fastener of the second pair is positioned along a second direction relative to a fourth fastener of the second pair. The first direction may form an acute angle with respect to the second direction. A third pair of fasteners may be configured to fasten to one another. A fifth fastener of the third pair is positioned along a third direction relative to a sixth fastener of the third pair, and the third direction may be substantially perpendicular to the first direction.

3 Claims, 2 Drawing Sheets

MULTIPURPOSE ATTACHABLE PROTECTIVE BLANKET

I. CLAIM OF PRIORITY

Figure 1:
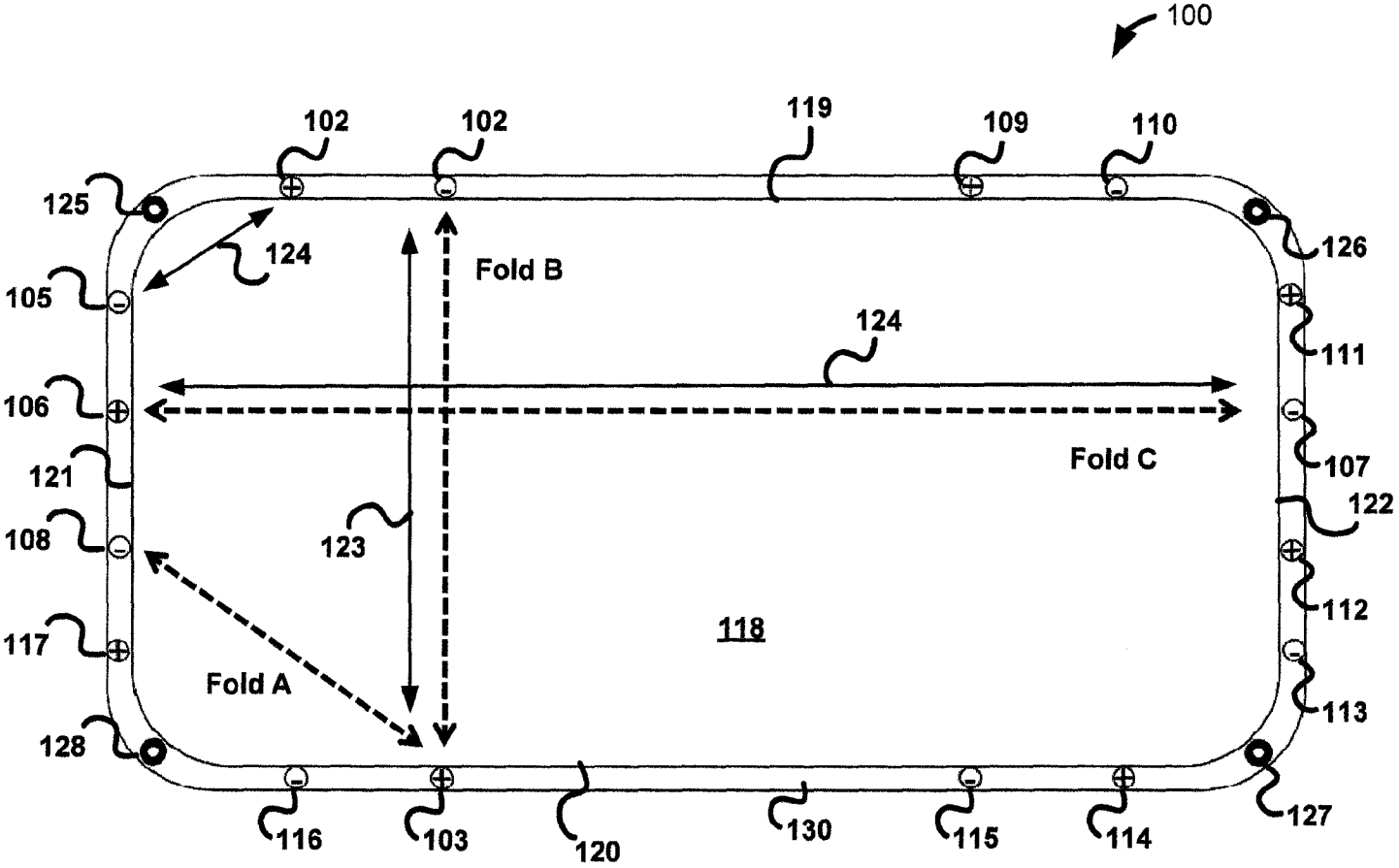

This application is a continuation patent application of, and claims priority from, U.S. Provisional Patent Application Ser. No. 61/639,983, filed on Apr. 29, 2012, and entitled, "Protective Blanket System," which is incorporated by reference herein in its entirety for all purposes.

II. FIELD OF THE DISCLOSURE

The present disclosure relates generally to protective coverings, and more particularly, to blankets used in connection with toddlers and infants and associated equipment.

III. BACKGROUND

Attentive parents and child care providers make efforts to protect infants from overexposure to sun and wind. Babies are particularly vulnerable to the elements when traveling in baby strollers, car seats, and carriers, many of which are not equipped with convenient or adequate canopies.

IV. SUMMARY OF THE DISCLOSURE

In a particular embodiment, an apparatus includes blanket material and a first pair of fasteners configured to fasten to one another. A first fastener of the first pair is positioned proximate to a first edge of the blanket material, and a second fastener of the first pair is positioned proximate to a second edge of the blanket material. The first edge is substantially parallel to the second edge. A second pair of fasteners is configured to fasten to one another. A third fastener of the second pair is positioned proximate to the first edge of the blanket material, and a fourth fastener of the second pair is positioned proximate to a third edge of the blanket material. The first edge is substantially perpendicular to the third edge.

A third pair of fasteners is configured to fasten to one another. A fifth fastener of the third pair is positioned proximate to the third edge of the blanket material, and a sixth fastener of the third pair is positioned proximate to a fourth edge of the blanket material. The third edge is substantially parallel to the fourth edge.

According to another particular embodiment, an apparatus includes blanket material and a first pair of fasteners configured to fasten to one another. A first fastener of the first pair is positioned along a first direction relative to a second fastener of the first pair. A second pair of fasteners may be configured to fasten to one another. A third fastener of the second pair is positioned along a second direction relative to a fourth fastener of the second pair.

According to an embodiment, the first direction forms an acute angle with respect to the second direction. A third pair of fasteners is configured to fasten to one another. A fifth fastener of the third pair is positioned along a third direction relative to a sixth fastener of the third pair, and the third direction is substantially perpendicular to the first direction.

According to another particular embodiment, the first direction is substantially perpendicular to the second direction. A third pair of fasteners is configured to fasten to one another. A fifth fastener of the third pair is positioned along a third direction relative to a sixth fastener of the third pair, and the third direction is substantially parallel to the first direction. According to another embodiment, a fifth fastener of the third pair is positioned along a third direction relative to a sixth fastener of the third pair, and the third direction forms an acute angle relative to the first direction.

Among other types of know fasteners, the first fastener may include at least one of: a snap, a button, a hook and loop-type fastener, a pin, string, a snap-type fastener, a hook, a magnet, glue, and tape. The apparatus may include at least eight pairs of fasteners and may additionally include grommets. The blanket material may include sun protective fabric and may have one or more rounded edges. An embodiment of the blanket material may include netting. The blanket material may further include a binding material attached to an outer edge.

According to another particular embodiment, a method of manufacturing a blanket includes positioning a first pair of fasteners on a blanket. The first pair of fasteners is configured to fasten to one another. A first fastener of the first pair is positioned along a first direction relative to a second fastener of the first pair. A second pair of fasteners may be positioned on the blanket. The second pair of fasteners may be configured to fasten to one another. A third fastener of the second pair is positioned along a second direction relative to a fourth fastener of the second pair.

The first direction of an embodiment may form an acute angle with respect to the second direction. A third pair of fasteners of an embodiment may be positioned on the blanket. A fifth fastener of the third pair is positioned along a third direction relative to a sixth fastener of the third pair. The third direction may be substantially perpendicular to the first direction. According to another embodiment, a fifth fastener of the third pair is positioned along a third direction relative to a sixth fastener of the third pair, and the third direction forms an acute angle relative to the first direction. A binding material may be positioned proximate an outer edge of the blanket.

Embodiments may be used as a baby blanket, swaddle blanket, nursing cover, sun and wind shelter and for additional UPF50+ sun protection. The versatile design may allow an embodiment of a blanket to fit securely around a baby stroller, infant car seat, baby carrier, pack and play or other baby gear to provide sun protection, shade, and shelter for your most beloved. Snap across corners, or along either length or width of the blanket to create a snug fit in even the windiest conditions. Having eight mating fasteners may enable a snug fit around baby stroller, carriers and other irregularly shaped enclosures.

Features that characterize embodiments are set forth in the claims annexed hereto and forming a further part hereof. However, for a better understanding of embodiments, and of the advantages and objectives attained through their use, reference should be made to the drawings and to the accompanying descriptive matter.

V. BRIEF DESCRIPTION OF THE DRAWINGS

Figure 2:
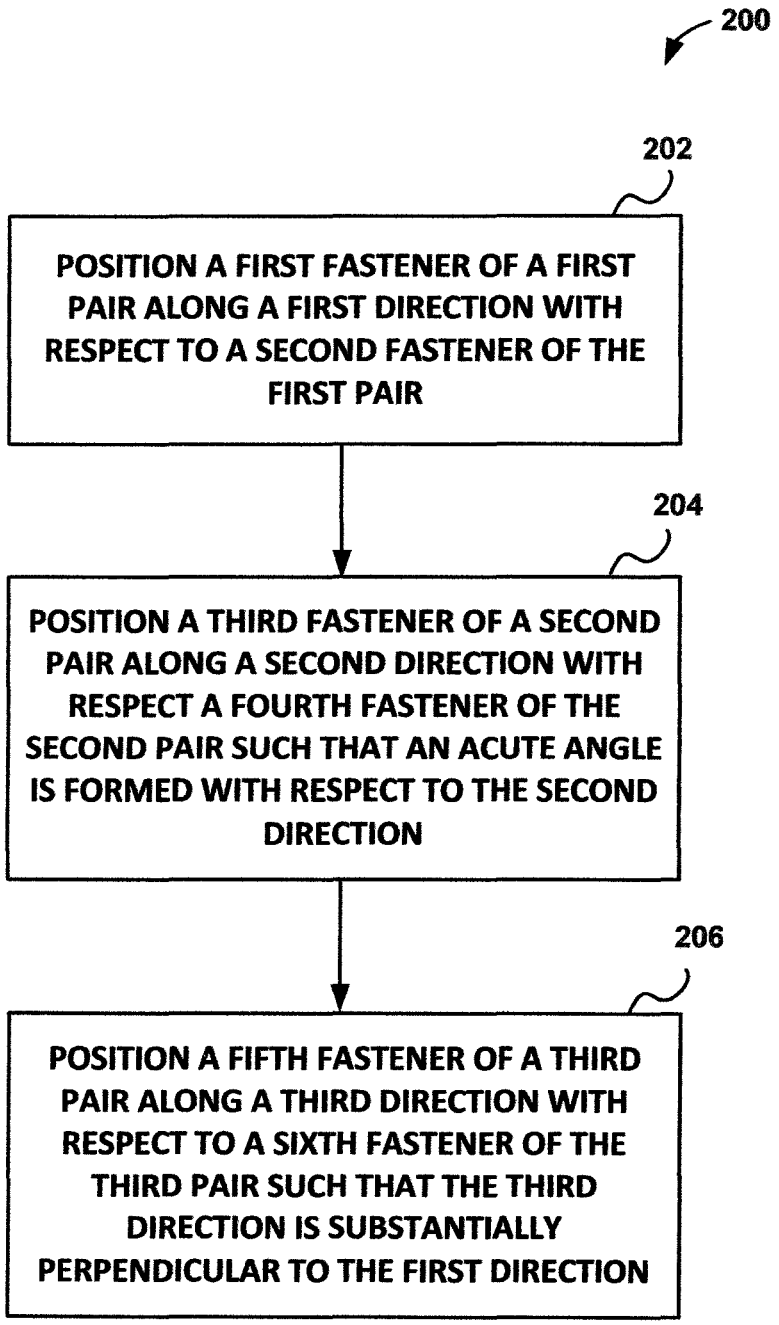

FIG. 1 an embodiment of an apparatus of a blanket having multiple fasteners each configured to fasten to one another towards attaching the blanket to a structure; and FIG. 2 is a flowchart of an embodiment of manufacturing a blanket, such as the apparatus of FIG. 1.

VI. DETAILED DESCRIPTION

An apparatus that is consistent with an embodiment may include a multi-purpose blanket that can be used in several ways to minimize the need for additional items and gear. The blanket may include sun protective fabric and may include fasteners that can be connected lengthwise, widthwise, and at its corners in order to be secured to a fixed object. That is, strategically placed fasteners may allow the blanket to create a fit around any solid item. The blanket may remain stationary in the windy conditions and may be used to create shelter or private area. An embodiment of the blanket is designed to work with existing baby gear, but is not exclusive to baby/toddler and children items. Embodiments of the blankets may be made out of a soft T-shirt weight, machine washable, Ultraviolet Protection Factor (UPF) 50 plus sun protective fabric.

An embodiment of the blanket may be used to create a sun and wind shelter, a standard blanket, swaddle blanket nursing cover, a private area, a curtain, a cover-up, a sun protection barrier, a mosquito barrier, a warm environment, or a cool shady place. The blanket may also be used as a sun sail. Embodiments of the blanket may be useful for any age group.

A blanket may be used indoors and outdoors and may replace several additional baby items (e.g. nursing cover, swaddling blanket, sun shades, etc.), allowing the blanket to be a versatile and everyday item. Blanket material of an embodiment may include sun protective fabric. Binding material around the perimeter of an embodiment may be constructed from heavier weight fabric that is folded and sewn around the perimeter of the blanket fabric to create strength for fasteners.

Embodiments of the fasteners may be used to create tight fits around solid items of a variety of shapes and sizes. Examples of such items may include, but are not limited to, baby carriers, strollers, pack and plays, and car seats. An embodiment may include eight pairs of snaps. Using a number of fasteners enables multiple snap variations and greater versatility. Each fastener may be configured to attach to another fastener.

An embodiment of the apparatus may include rounded edges to facilitate easy fastening/snapping across corners, or along either length or width of the blanket to create a snug and secure fit.

Grommets may be included for increased versatility. Grommets may allow an embodiment of a blanket to be function as a sun sail and may allow the blanket to be tethered in between fixed objects.

FIG. 1 shows an embodiment of an apparatus of a blanket having multiple fasteners each configured to fasten to one another towards attaching the blanket to a structure. As shown, eight pairs of fasteners, (e.g., snaps) may be strategically spaced and located so that a first fastener (e.g., a male snap) is directly or substantially across from a second fastener (e.g., a female snap). The first and second fasteners may allow the blanket to be fastened around an object when folded across corners (e.g., Fold A), folded in half width-wise (e.g., Fold B), or length-wise (e.g., Fold C). Grommets in each of the corners provide increased versatility by allowing the blanket to be used as a sun sail or to be tethered between fixed objects. UPF50+ sun-protective fabric may be used in one area. A colored binding may be positioned around the perimeter to provide improved strength and durability for holding the fasteners in place.

Turning more particularly to the Drawing, the apparatus 100 includes blanket material 118 and a first pair of fasteners configured to fasten to one another. A first fastener 102 of the first pair is positioned proximate to a first edge 119 of the blanket material 118, and a second fastener 103 of the first pair is positioned proximate to a second edge 102 of the blanket material 118. The first edge 119 may be substantially parallel to the second edge 120. A second pair of fasteners is configured to fasten to one another. A third fastener 104 of the second pair is positioned proximate to the first edge 119 of the blanket material 118, and a fourth fastener 105 of the second pair is positioned proximate to a third edge 121 of the blanket material 118. The first edge 119 may be substantially perpendicular to the third edge 121.

A fifth fastener 106 of a third pair of fasteners may be positioned proximate to the third edge 121 of the blanket material 118, and a sixth fastener 107 of the third pair may be positioned proximate to a fourth edge 122 of the blanket material 118. The third edge 121 may be substantially parallel to the fourth edge 122.

As such, the first fastener 102 of the first pair is positioned along a first direction, designated by arrow 123, relative to the second fastener 103 of the first pair. The third fastener 104 of the second pair is positioned along a second direction, designated by arrow 124, relative to the fourth fastener 105 of the second pair. According to the embodiment shown in FIG. 1, the first direction 123 forms an acute angle with respect to the second direction 124. A fifth fastener 106 of the third pair may positioned along a third direction, designated by arrow 124, relative to the sixth fastener 107 of the third pair. The third direction 124 may be substantially perpendicular to the first direction.

Although the fasteners 102-117 of FIG. 1 are depicted as male and female snaps, fasteners of other embodiments may include other types of know fasteners, such as buttons, hook and loop-type fasteners, pins, string, hooks, magnets, glue, and tape, among others. Additionally, while eight pairs of fasteners are depicted, another embodiment may include more or fewer. Additionally, while the fasteners 102-117 are shown arranged around the periphery of the apparatus 100, another embodiment may include fasteners positioned towards the interior of the blanket material 118 to provide additionally securing options. Likewise, the apparatus may include grommets 125-128 for additional securing options. While the grommets 125-128 of FIG. 1 are located proximate the corners of the apparatus 100, another embodiment may position additional grommets around the edges or interior of the blanket material.

The blanket material 118 may include sun protective fabric and may have one or more rounded edges. An embodiment of the blanket material may additionally include netting. While the blanket material 118 of FIG. 1 is shown as being rectangular in shape, the blanket of another may be trapezoidal, triangular, oval, circular, or any other shape. As shown in FIG. 1, the apparatus 100 may further include a binding material 130 attached to an outer edge. The binding material 130 may comprise a different material than the blanket material 118. For instance, the binding material 130 may be constructed of a relatively more durable material to reinforce or otherwise facilitate the function or attachment of the fasteners 102-117 and grommets 125-128. The binding material 130

FIG. 2 is a flowchart 200 of an embodiment of manufacturing a blanket, such as the apparatus of FIG. 1. According to the illustrative embodiment, a first pair of fasteners may be positioned on a blanket. The first pair of fasteners may be configured to fasten to one another. A first fastener of the first pair may be positioned at 202 along a first direction relative to a second fastener of the first pair.

A second pair of fasteners may be positioned on the blanket. The second pair of fasteners may be configured to fasten to one another. At 204, a third fastener of the second pair may be positioned along a second direction relative to a fourth fastener of the second pair. The first direction of an embodiment may form an acute angle with respect to the second direction.

A third pair of fasteners may be positioned on the blanket. More specifically, a fifth fastener of the third pair may be positioned at 206 along a third direction relative to a sixth fastener of the third pair. The third direction may be substantially perpendicular to the first direction.

While the present embodiments have been described in detail, it is not the intention of the Applicant to restrict, or any way limit the scope of the appended claims to such detail. The embodiments in their broader aspects are therefore not limited to the specific details, representative apparatus, methods, and illustrative examples shown and described. Accordingly, departures may be made from such details without departing from the scope of Applicant's general inventive concept.

The invention claimed is:

1. An apparatus comprising:

a generally rectangular blanket comprising Ultraviolet Protection Factor (UPF) sun protective fabric, the blanket having four rounded corners, a head end, a foot end, and two opposing sides located between the head and foot ends, wherein the head and foot ends each have a length lesser than the length of either of the opposing sides;

a plurality of fasteners releasably securable to each another, spaced apart from each other, and located along a perimeter of the blanket material such that the head end, the foot end, and each of the opposing sides each have at least one fastener of the plurality of fasteners, wherein the plurality of fasteners comprises:

a first pair of fasteners configured to fasten to one another, wherein a first fastener of the first pair is positioned proximate to a first edge of the blanket material, and a second fastener of the first pair is positioned proximate to a second edge of the blanket material, wherein the first edge is substantially parallel to the second edge;

a second pair of fasteners configured to fasten to one another, wherein a third fastener of the second pair is positioned proximate to the first edge of the blanket material, and a fourth fastener of the second pair is positioned proximate to a third edge of the blanket material, and wherein the first edge is substantially perpendicular to the third edge, and a third pair of fasteners configured to fasten to one another, wherein a fifth fastener of the third pair is positioned proximate to the third edge of the blanket material, and a sixth fastener of the third pair is positioned proximate to a fourth edge of the blanket material, and wherein the third edge is substantially parallel to the fourth edge; at least one grommet located proximate each of the four corners; and a strip of binding material having a durability greater than that of the sun protective fabric, the binding material being located along the entire perimeter of the blanket and having a width approximating a width of one of the fasteners or grommets, each of the fasteners and grommets being directly secured to the binding material, wherein the blanket is devoid of fasteners and grommets except along its perimeter.

2. An apparatus comprising:

a generally rectangular blanket comprising fabric, the blanket having four rounded corners, a head end, a foot end, and two opposing sides located between the head and foot ends, wherein the head and foot ends each have a length lesser than the length of either of the opposing sides;

a plurality of fasteners releasably securable to each another, spaced apart from each other, and located along a perimeter of the blanket material such that the head end, the foot end, and each of the opposing sides each have at least one fastener of the plurality of fasteners, wherein the space between each fastener is greater along each of the opposing sides than the space between each fastener along either the head end or the foot end, wherein the plurality of fasteners comprises:

a first pair of fasteners configured to fasten to one another, wherein a first fastener of the first pair is positioned proximate to a first edge of the blanket material, and a second fastener of the first pair is positioned proximate to a second edge of the blanket material, wherein the first edge is substantially parallel to the second edge;

a second pair of fasteners configured to fasten to one another, wherein a third fastener of the second pair is positioned proximate to the first edge of the blanket material, and a fourth fastener of the second pair is positioned proximate to a third edge of the blanket material, and wherein the first edge is substantially perpendicular to the third edge, and a third pair of fasteners configured to fasten to one another, wherein a fifth fastener of the third pair is positioned proximate to the third edge of the blanket material, and a sixth fastener of the third pair is positioned proximate to a fourth edge of the blanket material, and wherein the third edge is substantially parallel to the fourth edge; at least one grommet located proximate each of the four corners; and a strip of binding material having a durability greater than that of the fabric, the binding material being located along the entire perimeter of the blanket and having a width approximating a width of one of the fasteners or grommets, each of the fasteners and grommets being directly secured to the binding material, wherein the blanket is devoid of fasteners and grommets except along its perimeter.

3. An apparatus comprising:

a generally rectangular blanket comprising Ultraviolet Protection Factor (UPF) sun protective fabric, the blanket having four rounded corners, a head end, a foot end, and two opposing sides located between the head and foot ends, wherein the head and foot ends each have a length lesser than the length of either of the opposing sides;

a plurality of fasteners releasably securable to each another, spaced apart from each other, and located along a perimeter of the blanket material such that the head end, the foot end, and each of the opposing sides each have at least one fastener of the plurality of fasteners, wherein the space between each fastener is greater along each of the opposing sides than the space between each fastener along either the head end or the foot end, wherein the plurality of fasteners comprises:

a first pair of fasteners configured to fasten to one another, wherein a first fastener of the first pair is positioned proximate to a first edge of the blanket material, and a second fastener of the first pair is positioned proximate to a second edge of the blanket material, wherein the first edge is substantially parallel to the second edge;

a second pair of fasteners configured to fasten to one another, wherein a third fastener of the second pair is positioned proximate to the first edge of the blanket material, and a fourth fastener of the second pair is positioned proximate to a third edge of the blanket material, and wherein the first edge is substantially perpendicular to the third edge, and a third pair of fasteners configured to fasten to one another, wherein a fifth fastener of the third pair is positioned proximate to the third edge of the blanket material, and a sixth fastener of the third pair is positioned proximate to a fourth edge of the blanket material, and wherein the third edge is substantially parallel to the fourth edge; and a strip of binding material having a durability greater than that of the sun protective fabric, the binding material being located along the entire perimeter of the blanket and having a width approximating a width of one of the fasteners, each of the fasteners being directly secured to the binding material, wherein the blanket is devoid of fasteners except along its perimeter.

* * * * *